United States Patent [19]

Taylor

[11] Patent Number: 4,649,588

[45] Date of Patent: Mar. 17, 1987

[54] ELEVATED BIKEWAY

[76] Inventor: Graham Taylor, c/o 3955 Cedar Hill Rd., Victoria, B.C., Canada

[21] Appl. No.: 827,217

[22] Filed: Feb. 5, 1986

Related U.S. Application Data

[63] Continuation of Ser. No. 595,870, Apr. 2, 1984, abandoned.

[51] Int. Cl.[4] ..... E01D 9/00

[52] U.S. Cl. ..... 14/3; 14/73; 52/650; 182/130

[58] Field of Search ..... 14/3, 4, 6, 13, 17, 14/73; 182/222, 223, 130; 52/79.1, 263, 650, 731

[56] References Cited

U.S. PATENT DOCUMENTS

| | | | |
|---|---|---|---|
| 100,254 | 3/1870 | Brundage | 14/13 |
| 998,523 | 7/1911 | Jones | 14/3 |
| 1,176,994 | 3/1916 | Spelling | 14/3 X |
| 1,467,774 | 9/1973 | Braun | 14/73 X |
| 3,956,788 | 5/1976 | Nagin | 14/73 |
| 4,200,946 | 5/1980 | Lawrence | 14/4 |
| 4,253,210 | 3/1981 | Racicot | 14/13 X |

FOREIGN PATENT DOCUMENTS

| | | | |
|---|---|---|---|
| 1391134 | 1/1965 | France | 14/3 |
| 165961 | 1/1959 | Sweden | 14/3 |
| 1349749 | 4/1974 | United Kingdom | 14/13 |

OTHER PUBLICATIONS

"The Alcan Ingot", vol. XVIII, No. 7, published by Aluminum Company of Canada, Limited, Jul., 1959, pp. 1–3.

"Aluminum Bridge: A Lightness at Appomattox", *Engineering News—Record,* Jun. 8, 1961, pp. 30, 31.

*Primary Examiner*—Stephen J. Novosad
*Assistant Examiner*—John F. Letchford
*Attorney, Agent, or Firm*—Beveridge, De Grandi & Weilacher

[57] ABSTRACT

An elevated bikeway can be constructed to be extremely lightweight and therefore inexpensive by restricting use to bicycle traffic only and by using aluminum as substantially the only structural material. The bikeway includes two spaced apart trusses supporting horizontal bracing, which supports a deck tread surface.

8 Claims, 8 Drawing Figures

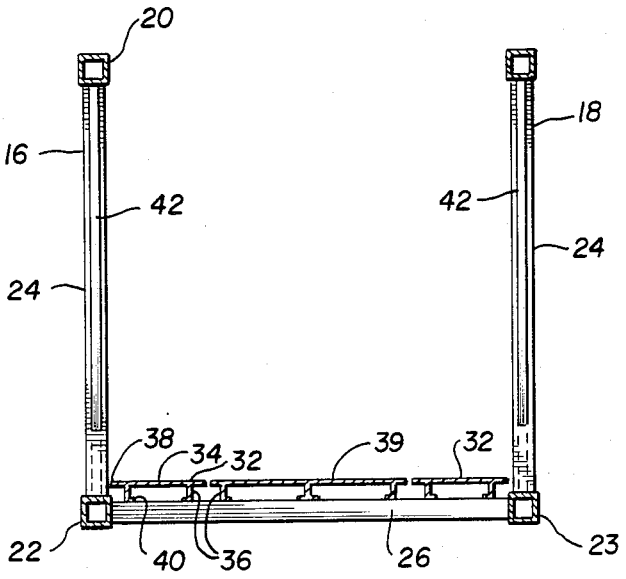
FIG. 2
FIG. 5
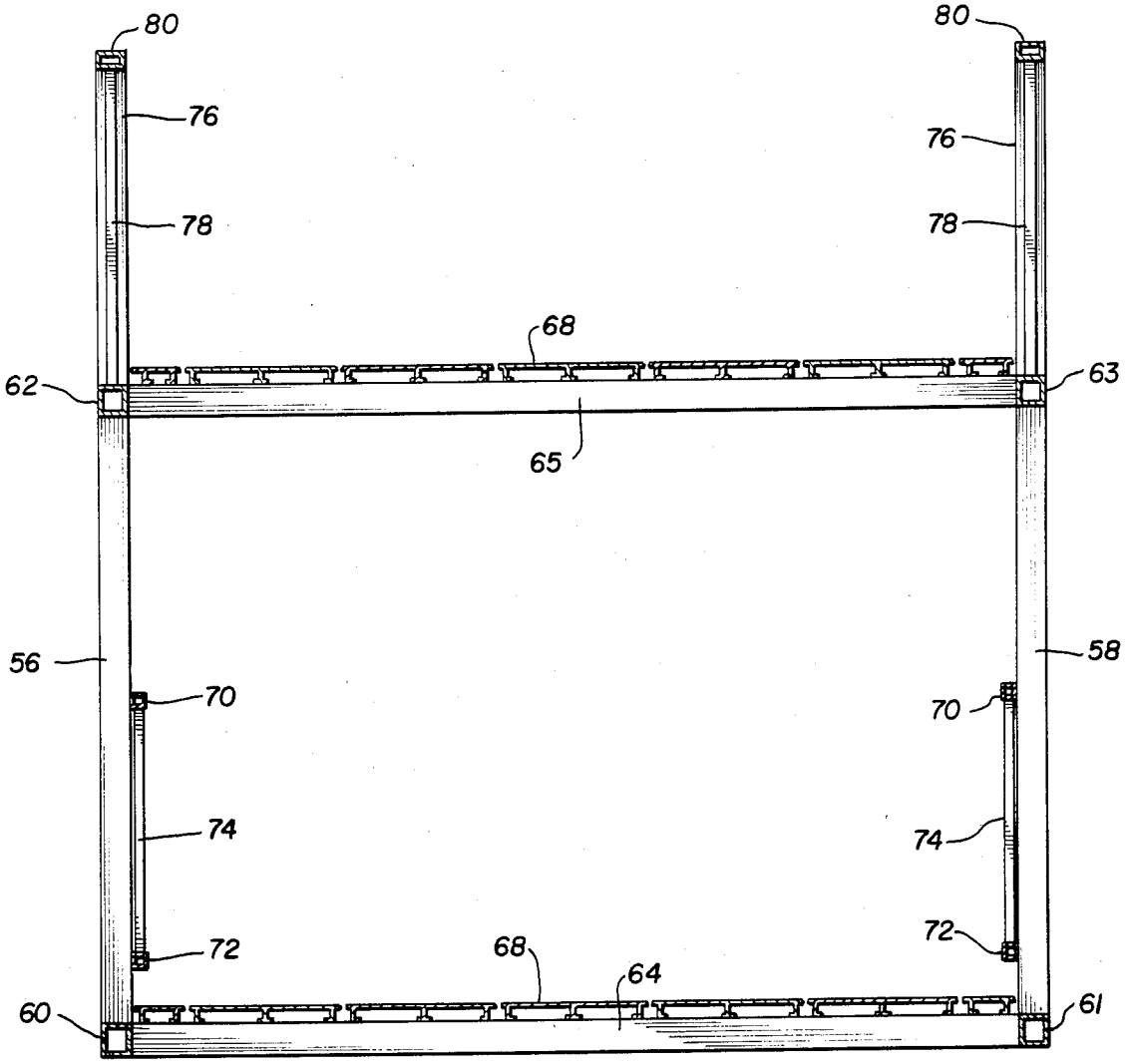

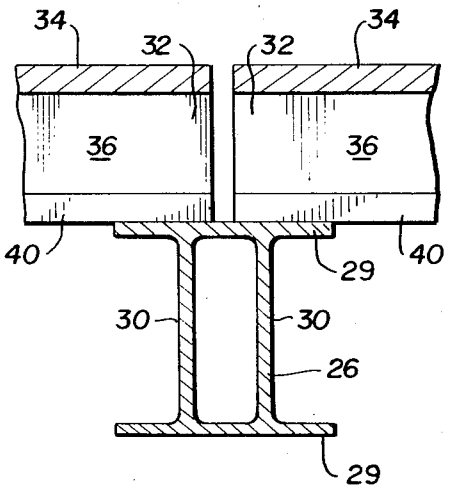
FIG. 7
FIG. 3
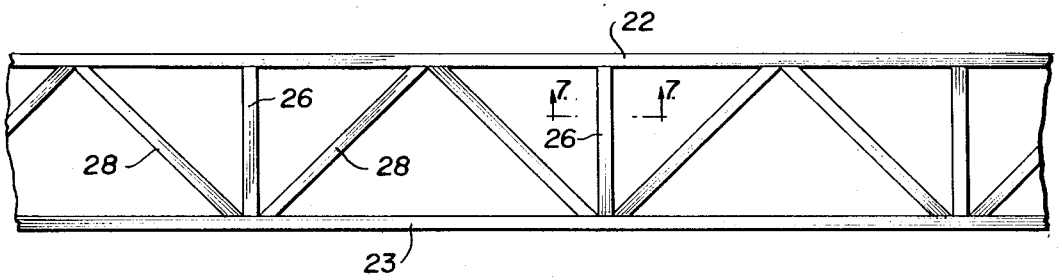
FIG. 6
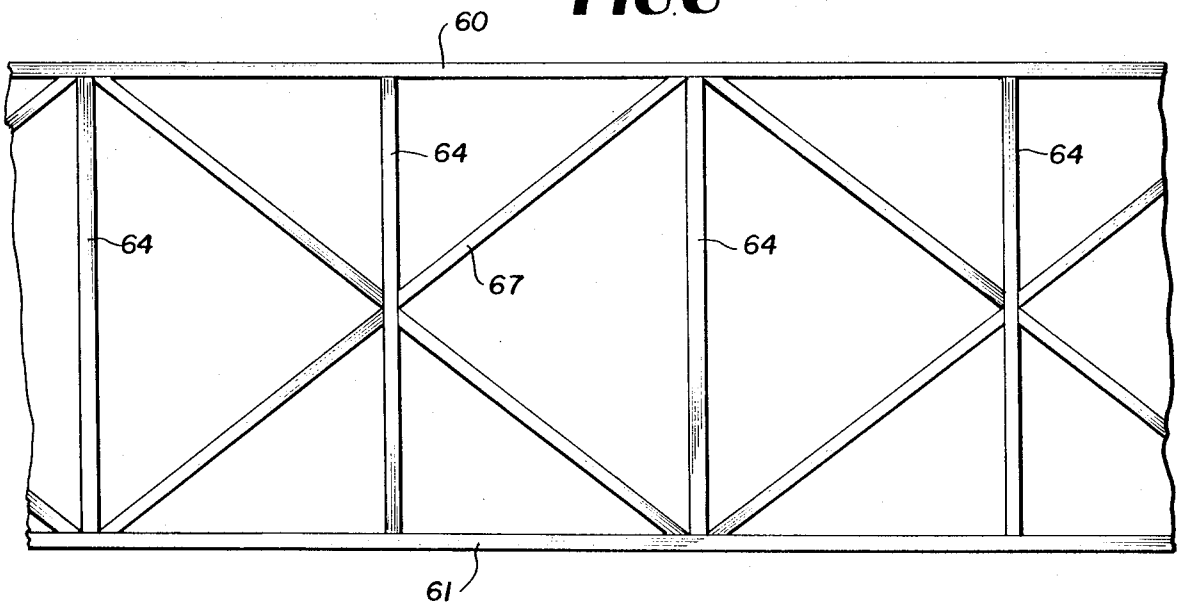

ELEVATED BIKEWAY

This application is a continuation of application Ser. No. 595,870, filed Apr. 2, 1984, now abandoned.

BACKGROUND OF THE INVENTION

The present invention relates to an elevated bikeway to provide a dedicated path for bicycle traffic isolated from both motor vehicle and pedestrian traffic. More particularly, it provides an elevated bikeway to carry bicycle traffic over roadways, streams, and other terrain features which are inhospitable to bicycle traffic.

Many of the problems of the United States and other industrialized countries can be traced to the emergence of widespread, almost universal, dependence on automobile transportation. Among these problems are inner-city decay and suburban sprawl, both brought about by the automobile; air pollution caused by automobile exhaust; great human suffering and loss of life arising from automobile traffic accidents; and landscapes blighted with automobile junkyards. Another serious problem is the steady decay in the physical well being of members of the population due to a lack of exercise. At first growing slowly, these negative side effects of reliance on automobiles have become pervasive.

There have been proposals to alleviate many of these problems by creating an alternate transportation system relying primarily on bicycles. There are now a few stalwart individuals in society who rely on bicycles for transportation almost exclusively. However, the number of persons so committed is small. The number has not increased primarily because of the lack of facilities for bicycles.

For want of a better route, most bicyclists today travel on streets and roadways at great danger to themselves from motorized vehicles sharing the same roadway. There have been suggestions to construct dedicated bike paths and bikeways limited solely to bicycle traffic. Such bikeways are commendable and the construction of them would encourage bicycling by additional members of the population.

However, the development of bikeways on a scale greater than mere tokenism has been retarded by cost projections.

One of the major expenses in constructing a dedicated bikeway is interfacing the bikeway path with the existing system of streets, roads, and other terrain features which might provide problems for a bicyclist. Dedicated pedestrian walkways are known, using concrete construction as overpasses for highways and the like, and local governments and other constructing authorities have generally assumed that this type of concrete structure would be necessary for a bikeway overpass. In view of the costs of such pedestrian overpasses the authorities have shunned the bikeway development concept.

Accordingly, there is a need in the art for an elevated bikeway which can be quickly and easily assembled at extremely low cost and which will provide a reliable structure for many years.

SUMMARY OF THE INVENTION

The present invention fulfills this need by providing an elevated bikeway which has a transportation path for bicycles and their riders at an elevation determined by the elevation of two supports. A span between the supports provides a tread surface for bicycle riding. The span is made substantially only of aluminum and is designed to have a minimum weight consistent with safe support of bicycle traffic. In one embodiment the span includes two horizontally spaced apart trusses extending the length of the span. Each truss is formed of vertically spaced apart chords made of tubular aluminum having a rectangular cross section and web members made of tubular aluminum extending obliquely between the chords. Horizontal bracing extends between the lower chords of the spaced apart trusses and includes perpendicular cross beams and oblique braces made of aluminum. A deck covers the horizontal bracing to provide a tread surface for bicycle riding. In one preferred embodiment the tread surface has at least one bicycle lane and the bikeway span has a weight less than about 40 pounds per lane per foot of span length.

Preferably, each of the trusses also has vertical safety bars extending between the chords of the truss. The safety bars are made of tubular aluminum having rectangular cross sections.

Preferably the perpendicular cross beams of the bracing have two parallel, vertically-spaced flanges and two parallel, horizontally-spaced webs between the flanges. The web members of the vertical trusses form angles with the chords of about 45° and the oblique braces form angles with the lower chords of about 45°. The bikeway has a design strength to handle a live load of about 12.5 pounds per square foot.

The deck is made of downwardly open aluminum channel members. No structural aluminum thickness exceeds about 3/16 of an inch.

In another embodiment, the invention provides two transportation paths for bicycles and their riders above ground level. Again there are two supports and a span between the supports. The span includes two horizontally-spaced apart trusses extending the length of the span. Each truss is formed of vertically-spaced apart chords made of tubular aluminum having a rectangular cross section and web members made of tubular aluminum extending obliquely between the chords.

In this embodiment a first horizontal bracing joins the lower chords of the spaced apart trusses and includes perpendicular cross beams and oblique braces made of aluminum. A first deck covers the first horizontal bracing to provide a first tread surface for bicycle riding. A second horizontal bracing joins the upper chords of the spaced apart trusses and includes perpendicular cross beams and oblique braces made of aluminum, and a second deck covers the second horizontal bracing to provide a second tread surface for bicycle riding. In this embodiment each tread surface has at least one bicycle lane and the bikeway span has a weight less than about 30 pounds per lane per foot of span length.

Safety barriers are provided attached to the trusses. These include horizontal top and bottom rails and vertical bars extending between the rails, located between the upper and lower chords. They also include banisters extending upwardly from each of the upper chords.

The perpendicular cross beams of this embodiment have two parallel, vertically-spaced flanges and two parallel, horizontally-spaced webs between the flanges. The web members of the vertical trusses form angles with the chords of about 45°. The bikeway has a design strength to handle a live load of about 12.5 pounds per square foot. In this embodiment, the trusses have a height of about 8 ½ feet. The decks are made of downwardly open aluminum channel members. In this embodiment, no structural aluminum thickness exceeds about 5/16 of an inch.

BRIEF DESCRIPTION OF THE DRAWINGS

The invention will be better understood from a reading of the following detailed description and a study of the drawings in which:

FIG. 2 is a sectional view taken along the lines 2—2 of FIG. 1;

FIG. 3 is a plan view of the bracing arrangement underlying the deck in the embodiment of FIG. 1;

FIG. 5 is a sectional view taken along lines 5—5 of FIG. 4;

FIG. 6 is plan view of the bracing arrangement underlying the decks in the embodiment of FIG. 4;

FIG. 7 is an enlarged sectional view taken along lines 7—7 in FIG. 3; and

DETAILED DESCRIPTION OF THE PREFERRED EMBODIMENTS

Figure 1:
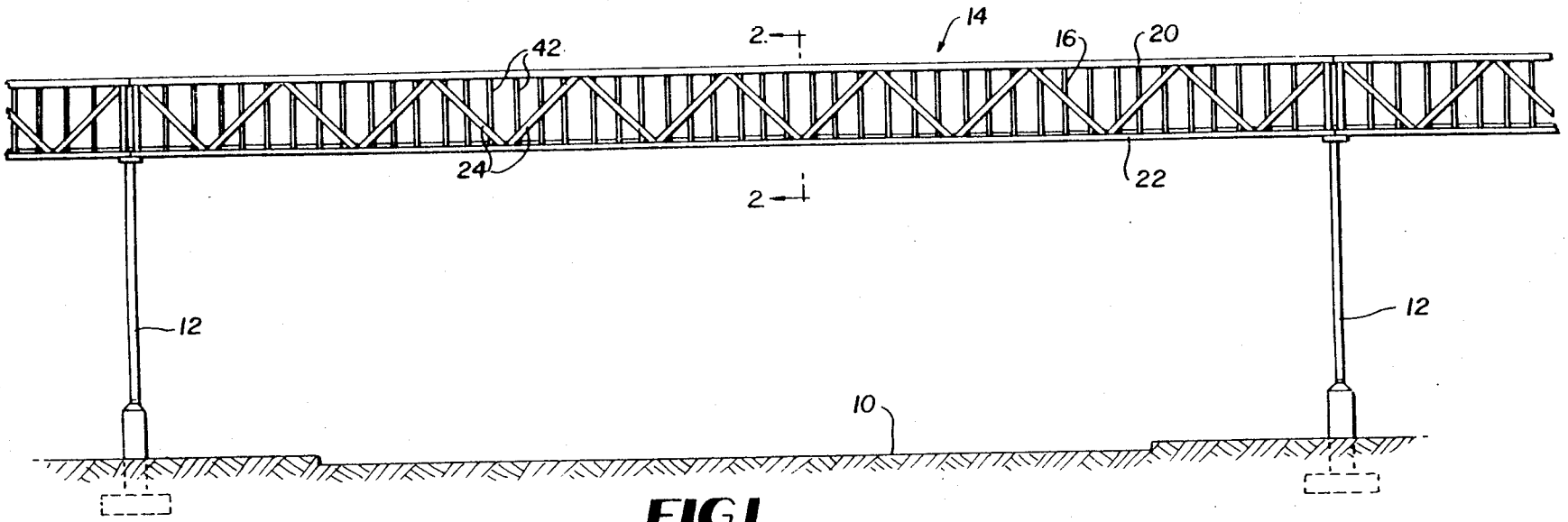
FIG. 1 is an elevational view of a bikeway according to one embodiment of the invention.

FIG. 1 shows an elevational view of a preferred embodiment of a single deck elevated bikeway. The bikeway is constructed of a minimum of materials and requires a minimum of labor to assemble, thereby making it a very inexpensive installation. The weight of the bikeway is considerably less than may be expected by extrapolating from the prior art. This is possible because the bikeway is made of aluminum structural members and because it is designed solely for use by bicycle traffic. The bikeway is designed with the assumption that a typical bicycle and rider will present a live load on the span of 250 pounds, including an impact allowance of 10%. It can be estimated that this load will be distributed over an area of 20 square feet, assuming a longitudinal dimension of five feet and a beam dimension corresponding to a lane width of four feet. Thus, the average live load is 12.5 pounds per square foot. This reduced design load estimate is less than one might postulate for a pedestrian overpass, but is permissible because the bikeway is limited exclusively to bicycle traffic. The design also contemplates using substantially only aluminum as the structural components to minimize the self weight of the span and further decrease the strength requirements. Design principles must conform to standards set forth in *Specifications for Aluminum Bridge and Other Highway Structures,* printed by the Aluminum Association in April 1976. Limiting the span to bicycle traffic and forming it of aluminum combine synergistically to provide a dramatically reduced span weight and construction cost.

Referring again to FIG. 1, a typical roadway 10 is depicted over which the bikeway will provide a transportation path for bicycles and their riders. On either side of the roadway is provided a support pier 12 which may be aluminum, concrete, steel, or other material as desired. In the embodiment of FIG. 1 the piers 12 are 70 feet apart. A span 14 extends between the piers. The single deck design of the embodiment is suitable for spans 30 to 100 feet in length. As can be seen in FIG. 1 additional spans or approaches can be provided to the right and left of span 14, depending upon the terrain requirements. Span 14 includes two trusses 16 and 18, each about 48 inches high. Truss 18 is shown in FIG. 2. Truss 16 includes an upper chord 20 and a lower chord 22. Each of chords 20 and 22 is made of a tubular aluminum having a square cross section, 3 inches on a side. The thickness of the tubular wall is 3/16 of an inch. Diagonal web members 24 extend between the chords and form oblique angles with the chords, preferably 45°, as shown in FIG. 1. The diagonal webs 24 are 68 inches long and made of tubular aluminum having a square cross section, with 2 ¾ inches on a side, and the tubular wall thickness is ⅛ of an inch. Truss 18 is formed in like manner.

Trusses 16 and 18 are joined by bottom bracing shown in FIGS. 2, 3 and 7. Lower chord 22 of truss 16 and lower chord 23 of truss 18 have perpendicular cross beams 26 and diagonal braces 28 extending between them. The diagonal braces are aligned at an angle of 45° and provide resistance to wind loading of the span. The diagonal braces 28 are 5.6 feet long and formed of tubular aluminum having a square cross section. The square has a side length of 2 ¾ inches and the tubular wall has a thickness of ⅛ inch. The perpendicular beams 26 are spaced along the span length 8 feet apart and have a unique form. One beam 26 is shown sectionally in FIG. 7. It has two spaced apart flanges 29 and two spaced apart webs 30. The flanges 28 and the webs 30 are each 2 ¾ inches long, with the webs 30 each spaced ½ inch from a center line of the flanges 29. The webs and flanges are all ⅛ inch thick.

The horizontal bracing, made up of diagonal braces 28 and perpendicular beams 26, supports a deck providing a tread surface. The tread surface is assembled from longitudinally extending channel sections 32. These channel sections can be seen most clearly in FIG. 2 and include upper plates 34 and downwardly extending flanges 36. Preferably the flanges 36 are spaced apart by a distance of about 10 inches, with upper plate overhangs 38 of two inches and horizontal bracing lips 40 one inch wide. The channel sections are made of aluminum 3/16 of an inch thick. A longitudinally extending central channel 39 is 24 inches wide but otherwise has dimensions comparable to those of channel section 32.

The foregoing parts are connected together by welding, providing strong joints and adding a minimum of weight. The channel sections 32 are arrayed on the horizontal bracing to cover the bracing and provide a surface running the length and width of the span 14.

The trusses 16 and 18 are further provided with safety bars 42 which extend the height of the truss and prevent riders from falling off of the span. The safety bars are made of tubular aluminum of square cross section. The square is one inch on a side and the tubular wall thickness is ⅛ of an inch. The safety bars are spaced along the length of the span on 17 inch centers.

The embodiment of FIG. 1 has a weight of only about 37 pounds per linear foot of span length or 9 ¼ pounds per square foot of deck. A steel pedestrian overpass weighs at least 75 pounds per square foot, and a concrete pedestrian overpass weighs 250 pounds per square foot of deck. Thus a dramatic weight reduction is achieved by designing for exclusive bicycle use and using structural aluminum. This decrease in weight translates into a decrease in cost. Assuming a conservative fabrication and erection cost of $2.50 a pound for aluminum structures, the embodiment of FIG. 1 would cost about $23.00 per square foot in place. This is comparable to current estimates of $100 per square foot for girder superstructure pedestrian overpasses. By the use of lightweight materials smaller and less expensive cranes are needed in construction.

A second embodiment is seen in FIGS. 4, 5, 6 and 7. This bikeway 50 provides for two levels on which traffic can travel and is similar to the embodiment of FIG. 1 but spans up to 200 feet in length as contemplated. Trusses 56 and 58 are provided on the two sides of the bikeway, as seen in FIG. 5. Truss 56 includes a lower chord 60 and an upper chord 62 approximately 8 ½ feet apart. Diagonal web members 64 extend between chords 60 and 62, preferably at an angle of 45°. The web members 64 are welded to chords 60 and 62. Chords 60 and 62 are made of tubular aluminum having a square cross section. The square is four inches on a side and the wall thickness is 5/16 of an inch. The web diagonals are made of tubular aluminum having a square cross section 3 ½ inches on a side and 5/16 inch thick. Truss 58 is made of similar chords and web diagonals.

The trusses are held apart by horizontal bracing as shown in FIG. 6. Such horizontal bracing is used to separate the lower chord 60 of truss 56 and the lower chord 61 of truss 58. The horizontal bracing includes perpendicular beams 64, which have a shape similar to beams 26, except that they are 4 inches wide, 3 inches high, ⅛ inch thick and 12 feet long. Also in this embodiment, the oblique braces 67 extend from near the intersection of one chord and perpendicular beam to near the middle of the adjacent perpendicular beam, as can be seen in FIG. 6. They are about 10'4" long. The oblique braces 67 are made of tubular aluminum having a square cross section with 3 ½ inches on a side and ⅛ inch thick. A similar set of bracing members 65 separate upper chords 62 and 63 of trusses 52 and 56, respectively.

Each of the upper and lower horizontal braces has longitudinally extending channel members 68 thereon to provide a tread surface on which bicycles are ridden. The channel members 68 are similar to the channel members of the first embodiment. In this embodiment the horizontal bracing is 12 feet in breadth, making three 4 foot lanes for bicycle traffic.

Alternatively, the horizontal bracing can be eliminated and the deck forming members can be provided integral with the chords. In such a case the top plate of the deck extends between the chords and has downwardly-depending T-shaped deck stiffeners running longitudinally at typically 8 inch centers. The plate is ¼ inch thick and the stiffeners are 3/16 inch thick. The web and flange of the T are each 2 inches wide.

A safety barrier arrangement is provided for each level. The lower level safety barrier includes an upper rail 70 and a lower rail 72 made of tubular aluminum having a square cross section. The square is 2 inches on a side and 3/16 inch thick. Extending vertically between upper rail 70 and lower rail 72 are safety bars 74 made of tubular aluminum having a square cross section 1 inch on a side and ⅛ inch thick. The safety bars are located along the length of the span 50 on 16 inch centers. The safety barrier for the upper level takes the form of a banister 76 and includes safety bars 78 made of tubular aluminum having a square cross section 1 inch on a side and ⅛ inch thick, on 16 inch centers. The top rail 80 is made of tubular aluminum having a rectangular cross section of dimensions 4 inches by 2 inches, ⅛ inch thick. All parts are assembled by welding to provide a maximum strength with a minimum addition of weight.

This structure results in an elevated bikeway having a weight of 155 pounds per foot of the span. This corresponds to a weight of about 6.5 pounds per square foot of deck. As can be appreciated, this provides an even greater decrease in weight over comparable steel or concrete structures, which translates into a substantial constructional cost savings. Again assuming a conservative fabrication cost of $2.50 a pound, this structure could be built for about $16 per square foot.

The invention is capable of taking various other forms while falling within the scope of applicant's invention. What is important is that the designs include the use of substantially only aluminum as a structural material and that the intended load be limited to bicycle traffic exclusively. With these parameters in mind a much lighter and therefore much less expensive bikeway can be assembled.

Figure 4:
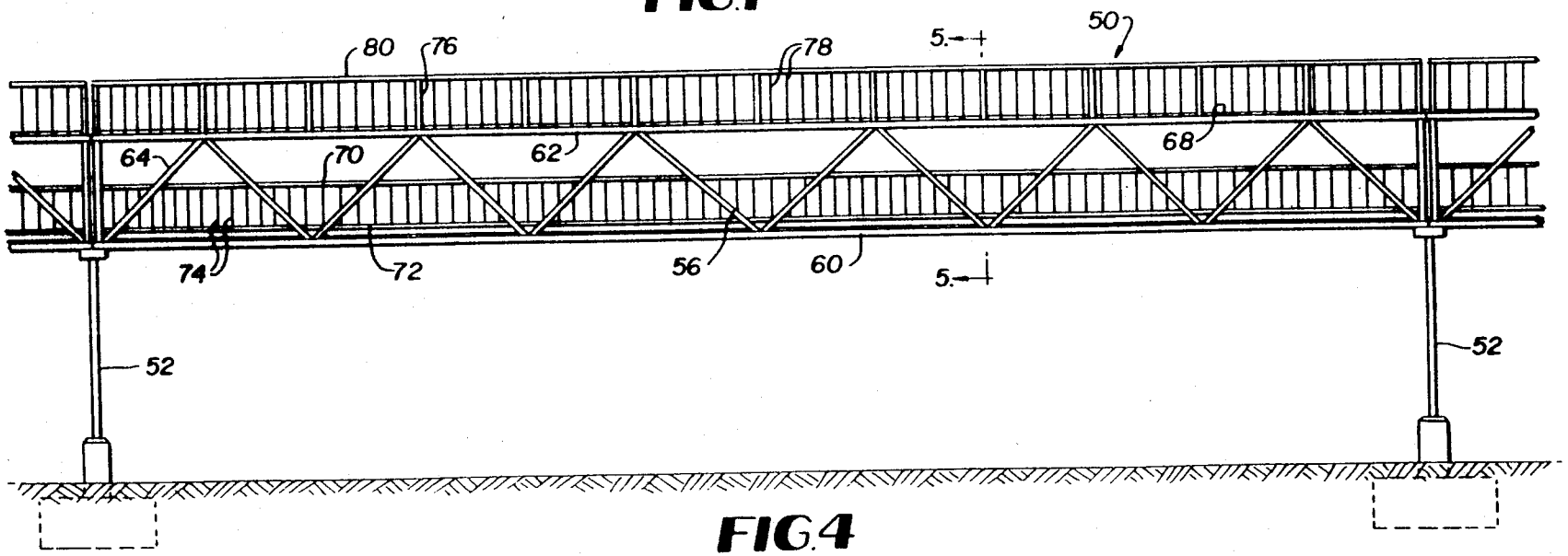
FIG. 4 is an elevational view of a bikeway according to another embodiment of the invention.
Figure 8:
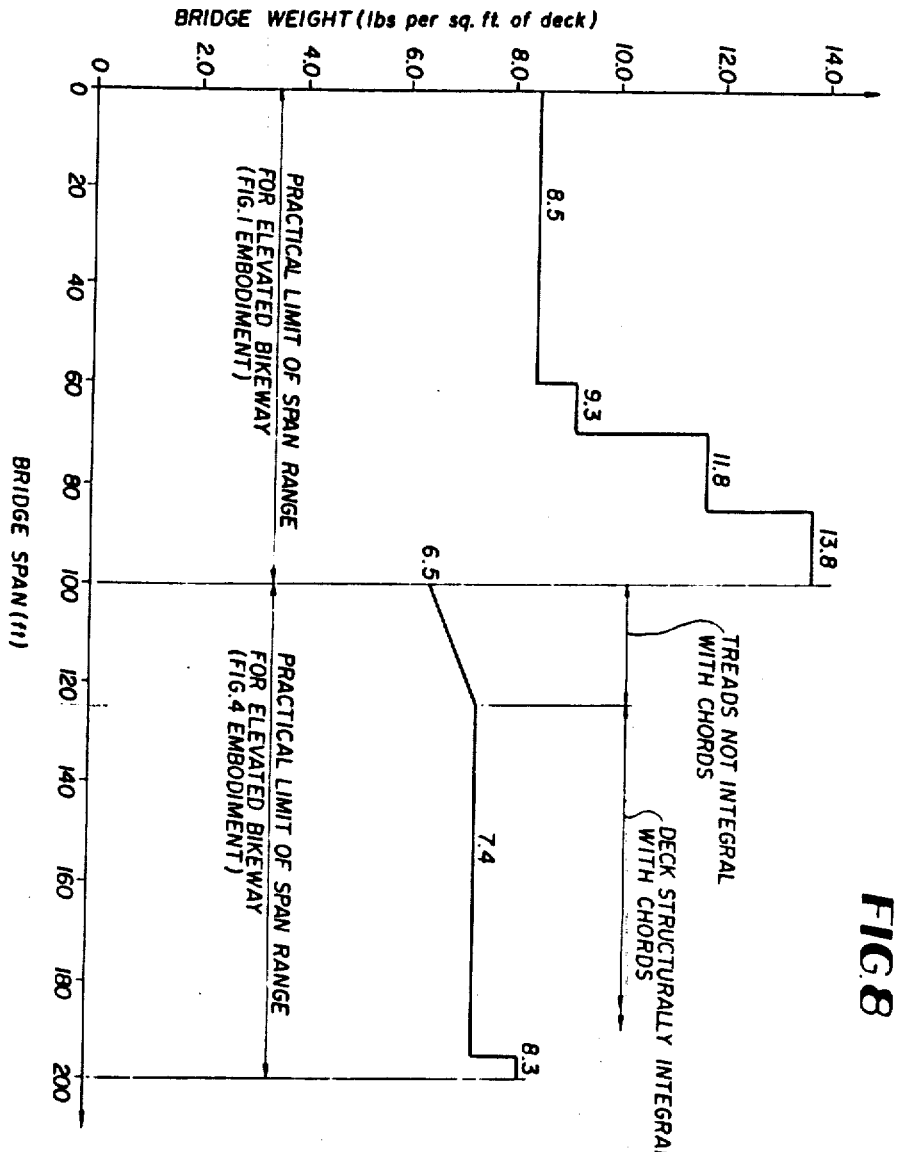
FIG. 8 is a graph showing calculated span weight per square foot for various span lengths.

For example, using the designs disclosed herein, bikeways up to 200 feet long can be constructed. FIG. 8 shows span weight per square foot for various span lengths. For lengths from 1 to 100 feet, the single deck span of FIG. 1 is used. Incremental increases in weight per foot at 60, 70 and 85 foot lengths arise as various span components must be made stronger. For lengths from 101 to 200 feet, the two level span of FIG. 4 is used. The gradual increase in weight from 101 to 124 feet is characteristic of the fact that the decks are not integral with the chords. From 125 to 196 feet the decks are integral. At 196 feet, the components must be further increased in strength. Given the general design parameters disclosed herein, those of ordinary skill should, with reference to the above-mentioned *Specifications for Aluminum Bridge and Other Highway Structures* publication, be able to design and build suitable structures without further detailed description herein. Various modifications can be made to suit conditions.

Thus many of the problems generated by excessive reliance on motorized vehicles can be overcome because communities will be able to afford to construct dedicated bikeways. This will allow citizens to rely more on bicycle transportation and less on dangerous, polluting, unhealthy automobiles.

What is claimed is:

1. An elevated bikeway providing a transportation path dedicated exclusively to bicycle traffic above ground level comprising, two supports and a span between said supports, said supports being spaced from about 30 to about 100 feet apart, said span including two horizontally-spaced apart trusses extending the length of said span, each of said trusses having vertically-spaced apart chords made of tubular aluminum, web members extending diagonally between and secured to said chords to form oblique angles with said chords, said diagonal members also being made of tubular aluminum, and safety bars extending between and secured to said chords to prevent riders from falling off said span, horizontal bracing joining the lower chords of said spaced apart trusses, said horizontal bracing including diagonal braces extending between and connected to said lower chords at angles for providing a resistance to wind loading of said span, said diagonal braces being made of tubular aluminum and cross beams extending between and secured to said lower chords, said cross beams being perpendicular to said lower chords and being spaced apart for the length of said span, each of said cross beams having two spaced apart flanges and two spaced apart webs disposed between and perpendicular to said flanges, and a deck covering said horizontal bracing for providing a surface for bicycle riding, said bikeway having a span weight per square foot of deck per span length as defined in the graph of FIG. 8.

2. A bikeway as defined in claim 1, wherein said bikeway has a design strength to handle a live load of about 12.5 pounds per square foot.

3. The bikeway as defined in claim 2, wherein said bikeway has a weight of approximately 9 ¼ pounds per square foot of deck.

4. The bikeway as defined in claim 1 wherein said deck comprises a longitudinally extending central channel section and adjacent longitudinally extending channel sections parallel thereto and forming said surface, said channel sections having downwardly extending, spaced apart flanges, said flanges including horizontal bracing lips in contact with and secured to said perpendicular cross beams.

5. The bikeway as defined in claim 1 wherein said tubular aluminum is of rectangular cross-section.

6. An elevated bikeway providing two transportation paths, one directly above the other, and exclusively dedicated to bicycle traffic above ground level comprising, two supports and a span between said supports, said supports being spaced up to about 200 feet apart, said span including two horizontally spaced apart trusses extending the length of said span, each of said trusses having vertically-spaced apart chords made of tubular aluminum, web members extending diagonally between said chords and secured thereto to form oblique angles with said chords, said diagonal members being made of tubular aluminum, horizontal bracing joining the lower chords of said vertically-spaced apart chords to form one of said paths of said span, horizontal bracing joining the upper chords of said spaced apart trusses to form another of said paths of said span, said horizontal bracing joining said chords including diagonal braces extending between and connected to said lower chords and extending between and connected to said upper chords at angles for providing a resistance to wind loading of said span, said diagonal braces being made of tubular aluminum, cross beams extending between and connected to said lower chords and extending between and connected to said upper chords, said cross-beams being perpendicular to said respective upper and lower chords and being spaced apart for the length of said span, each of said cross-beams having two spaced apart flanges and two spaced apart webs disposed between and perpendicular to said flanges, a deck covering said horizontal bracing of each of said paths and providing a surface for bicycle riding, a pair of chords spaced above the upper chords of said spaced apart trusses and safety bars extending between and secured to said chords to prevent riders from falling off said upper path, and safety bars extending upwardly from and secured to said lower chords to prevent riders from falling off said lower path, said bikeway having a span weight per square foot of deck per span length as defined in the graph of FIG. 8.

7. The bikeway as defined in claim 6, wherein said bikeway has a design strength to handle a live load of about 12.5 pounds per square foot.

8. The bikeway as defined in claim 7 wherein said bikeway has a weight of about 6.5 pounds per square foot of deck.

* * * * *

UNITED STATES PATENT AND TRADEMARK OFFICE

CERTIFICATE OF CORRECTION

PATENT NO. : 4,649,588

DATED : March 17, 1987

INVENTOR(S) : Graham Taylor

It is certified that error appears in the above-identified patent and that said Letters Patent is hereby corrected as shown below:

In the drawings, Sheet 4, which is attached hereto and which includes Figure 8, should be added as per attached Sheet.

Signed and Sealed this

Fifth Day of April, 1988

*Attest:*

DONALD J. QUIGG

*Attesting Officer*

*Commissioner of Patents and Trademarks*